United States Patent [19]

Goldfarb et al.

[11] 3,947,028

[45] Mar. 30, 1976

[54] TOY BOWLING GAME

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 10, 1975

[21] Appl. No.: 548,782

[52] U.S. Cl. ..... 273/41; 273/127 D
[51] Int. Cl.[2] ..... A63D 3/00
[58] Field of Search ..... 273/37, 38, 39, 41, 127 D

[56] References Cited

UNITED STATES PATENTS

| | | | |
|---|---|---|---|
| 627,712 | 6/1899 | Wemple | 273/41 |
| 941,793 | 11/1909 | DeMeurisse | 273/41 |
| 1,097,937 | 5/1914 | Purnell | 273/41 |
| 1,111,592 | 9/1914 | Keenan | 273/41 |
| 1,502,183 | 7/1924 | France | 273/38 |
| 1,904,033 | 4/1933 | Schulze et al. | 273/41 |
| 2,478,134 | 8/1949 | Smith | 273/41 UX |

*Primary Examiner*—Anton O. Oechsle
*Attorney, Agent, or Firm*—Robert M. Ashen; Robert J. Schaap

[57] ABSTRACT

A children's bowling game comprising a frame having a bowling alley included therewith, and which is slightly inclined downwardly from a ball propelling end toward an end remote therefrom. The remote end carries a plurality of upstanding elements which have the silhouette of bowling pins, and which are located in the arrangement of normal bowling pins. These elements, however, are relatively flat members. A recess is located immediately behind each of the bowling pins which are hingedly mounted with respect to the bowling alley, so that the bowling pins will be shifted from a first upstanding position to a second flat position where they are located in the recesses when contacted by the bowling ball. In this way, the upper surface of the bowling pins are flush with the surface of the bowling alley when in a second position. An actuating means is also associated with the frame in order to shift the pins to the upright or first position by means of a manually operable lever. In addition, several of the bowling pins in the set are automatically shifted to the second position when one or more bowling pins associated therewith are shifted to the second position by the bowling ball even though the first mentioned bowling pins are not so contacted by the bowling ball. In this way, it is possible to achieve a strike when the bowling ball is properly located in a strike position with respect to the bowling pins.

7 Claims, 18 Drawing Figures

TOY BOWLING GAME

BACKGROUND OF THE INVENTION

This invention relates in general to certain new and useful improvements in bowling games and, more particularly, to bowling games in which bowling pin elements are hingedly mounted on a bowling alley and can be shifted from a first upstanding position to a second flat position relatively co-planar with the bowling alley when contacted by a playing piece.

Children's bowling games have long been popular and commercially acceptable among school-aged and older children. These bowling games usually adopt various different forms of construction. In the first of these bowling games, the bowling pins are suspended along one or more guy wires, or similar supporting member, extending transversely across a bowling alley in such manner that they are pivotally supported in slightly spaced relationship to a bowling alley which receives a rolling ball. Consequently, when the ball contacts any of the bowling pins suspended on the guy wire or similar supporting member, the bowling pins will pivot on the wire in order to visually depict the score of the player. This form of bowling game is somewhat deficient in that the children recognize that it does not conform to the principles of operation of the true game of bowling.

Another form of children's bowling game employs a construction where each bowling pin is suspended on an individual guy wire. The guy wire is biased upwardly but restrained against upward movement by an interlock. When the bowling pin is contacted by a bowling ball, the interlock is released and the guy wire is raised in such manner that the bowling pin is pulled upwardly. The major deficiency with this form of bowling game is that the various guy wires tend to become entangled. Due to these various problems, preschool children have tended to lack interest in toy bowling games, and consequently the preschool bowling game market was relatively unsuccessful.

In order to overcome these deficiencies, there have been several forms of bowling games where the bowling pins are freely located and manually set upon the alley in the desired location and pattern. While these latter forms of bowling games adopt a more realistic resemblance to the true game of bowling, they are also deficient in the ease and efficiency in which the game may be played. In this latter form of game, the players must engage in the time consuming procedure of setting the bowling pins on an alley in a prescribed location. In this case, the bowling alley may be provided with indicia in order to provide indication of the desired location of each particular bowling pin. This activity is not only time-consuming and cumbersome, but actually militates against the acceptance of the game.

The present invention obviates these and other problems in the provision of a bowling game in which the bowling pins in the form of upstanding elements are hingedly mounted on the bowling alley in an upstanding or first position, and can be shifted to a second position when engaged by a playing piece, such as a ball representative of a bowling ball. Moreover, when the bowling pins are knocked to the second or down position, they can be easily re-shifted to the first position by means of actuating a simple, manually operable actuating member. A recess is located behind each pin so that the bowling pin can shift to and be located in the recesses in the second position. In this way, the upper surface of the pins become co-planar with the surface of the bowling alley in order to prevent interference with a second roll of the ball. Moreover, some of the bowling pins are coupled to other of the bowling pins in such manner that the first of these mentioned bowling pins will automatically shift to the second of the positions when the other bowling pins are contacted by the bowling ball. Consequently, the player of the game can achieve an automatic strike by properly locating the ball with respect to the bowling pins.

It is therefore the primary object of the present invention to provide a toy bowling game which can be played in such manner that it approximates the actual game of bowling.

It is another object of the present invention to provide a toy bowling game of the type stated which is highly durable in its construction and can withstand the abuse normally subjected thereto by pre-school children.

It is a further object of the present invention to provide a toy bowling game of the type stated in which the bowling pins can be automatically shifted from the "down" position to the upstanding position by means of simple mechanical actuation of a lever associated with the bowling alley.

It is an additional object of the present invention to provide a toy bowling game of the type stated which is relatively simple in its construction and involves a unique linkage mechanism in order to properly locate and shift each of the bowling pins after the number of desired rolls of a playing piece representative of a bowling ball.

It is another salient object of the present invention to provide a method of playing a toy bowling game which approximates that of the normal game of bowling.

With the above and other objects in view, our invention resides in the novel features of form, construction, arrangement and combination of parts presently described and pointed out in the claims.

SUMMARY OF THE DISCLOSURE

This invention relates in general to children's bowling games, and, more particularly, to a form of pre-school children's bowling game, which includes an outer frame and a bowling alley located within the frame. In this case, the bowling alley is slightly inclined downwardly from the goal line or area where the player propels the playing piece, as for example, in the form of a ball which is representative of a bowling ball. At the opposite end of the bowling alley, a plurality of elements representative of bowling pins are located in substantially the same arrangement as bowling pins would be located in a normal bowling alley. Consequently, in the case of the present invention, ten such bowling pins are located where one bowling pin is located in the first of the rows, two bowling pins are located in the second of the rows, three bowling pins are located in the third of the rows, and four bowling pins are located in the fourth of the rows to form a somewhat triangular set of the bowling pins.

A recess is located immediately behind each of the bowling pins so that when the bowling pin is knocked from its upstanding, or first position, to its down, or second position, the outwardly presented planar surface of the bowling pin is flush with the surface of the bowling alley. In this way, it is possible to roll the bowling ball a second time in accordance with the normal rules of bowling without interference of those pins which have been previously knocked down to the second position. Moreover, it can be observed that these bowling pins are hingedly connected to the bowling alley immediately adjacent to and in relation to the recess so that they are accommodated by the recess when knocked down to the second position.

The various bowling pins are hingedly connected on the bowling alley in such manner that each of the pins are located with respect to each other by a sufficient dimension so that each of the bowling pins can be moved from the first position to the second position without contacting any other bowling pin. In addition, a manually operable actuating means is located on the underside of the frame for shifting each of the bowling pins to the first or upright position, after they have been knocked down to the second position by means of being contacted by a playing piece such as the bowling ball. This actuating means preferably adopts the form of a manually operable lever which shifts a camming plate. The camming plate contains a number of cams which operate to contact camming flanges on the under side of each of the bowling pins to thereby shift these pins to the first position.

In the device of the present invention, two of the outermost bowling pins in the third row are coupled to the two bowling pins in the second row. This coupling occurs in such manner that the two outermost bowling pins in the third row are shifted to the second position when the two bowling pins in the second row are shifted to the second position even though the bowling pins in the third row are not so contacted by the playing piece. In addition, the two outermost elements in the fourth row are coupled to the next two adjacent elements inwardly thereof in the fourth row such that when the next innermost bowling pins in the fourth row are shifted to the second position, the outermost of the pins are shifted to the second position even though such outermost bowling pins have not been contacted by the playing element.

The linkage mechanisms mentioned above are uniquely designed so that the two outermost elements in the fourth row may be shifted to the second position when contacted by the playing piece without thereby shifting the next adjacent playing piece to the second position. In like manner, the linkages between the bowling pins in the second and the third rows are also uniquely designed so that the two outermost bowling pins in the third row may be contracted by the playing piece to be shifted to the second position without shifting the bowling pins in the second row to the second position.

BRIEF DESCRIPTION OF THE DRAWINGS

Figure 1:
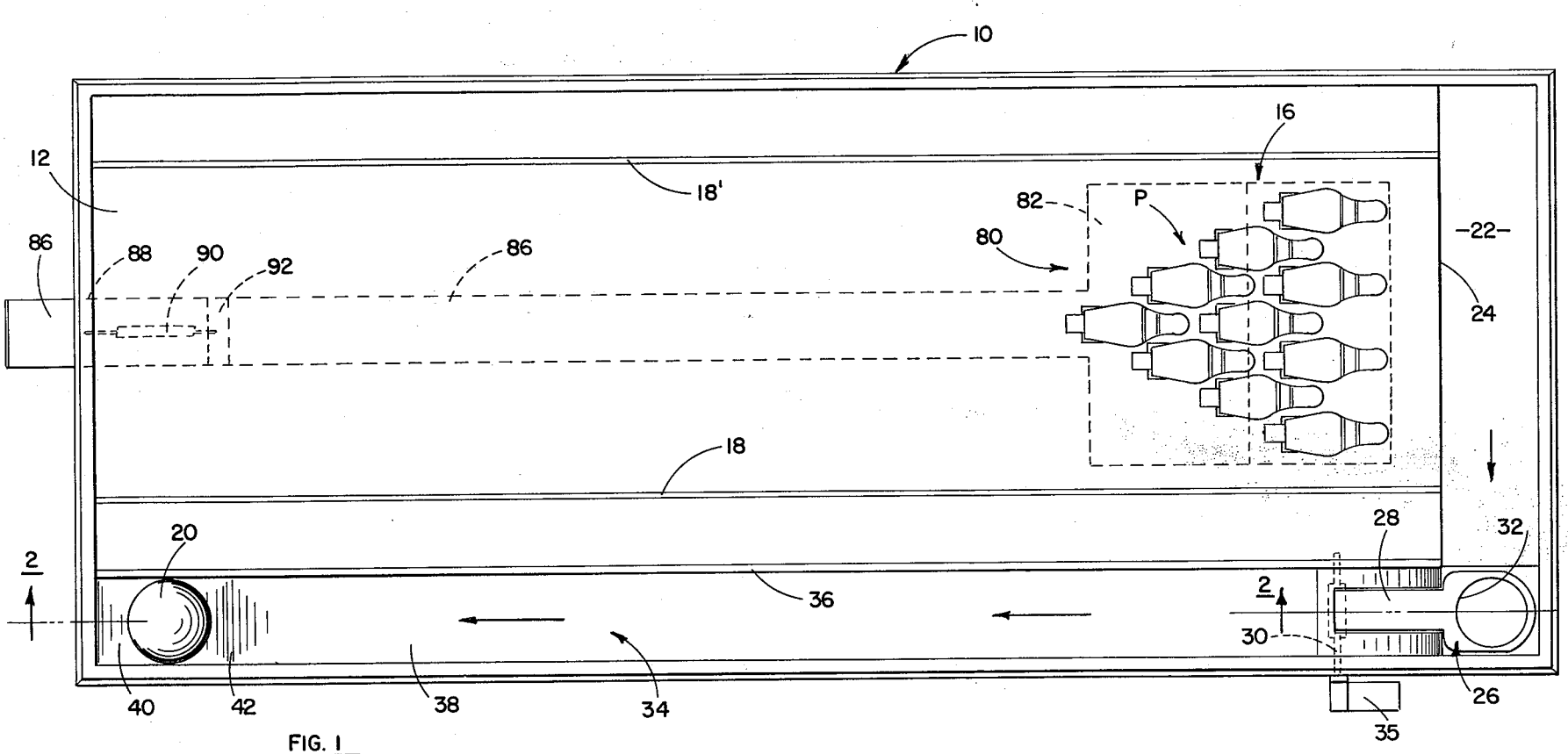
Figure 2:
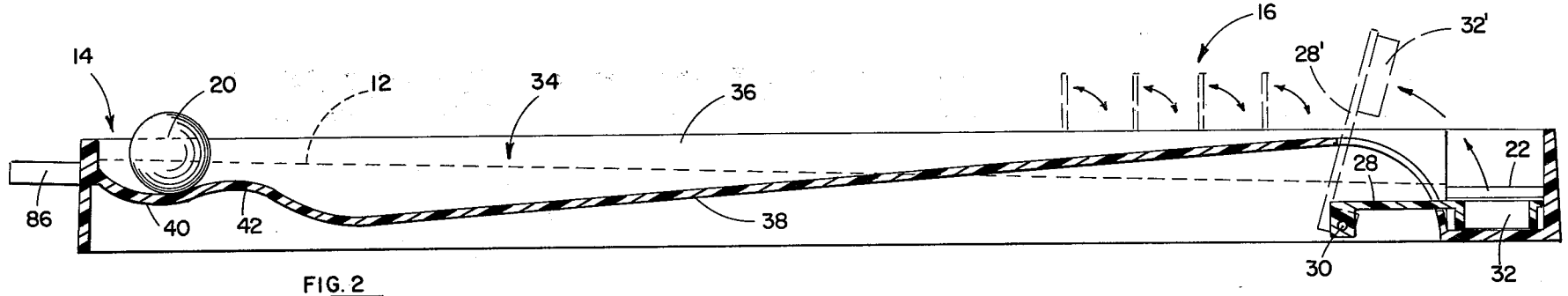
Figure 5:
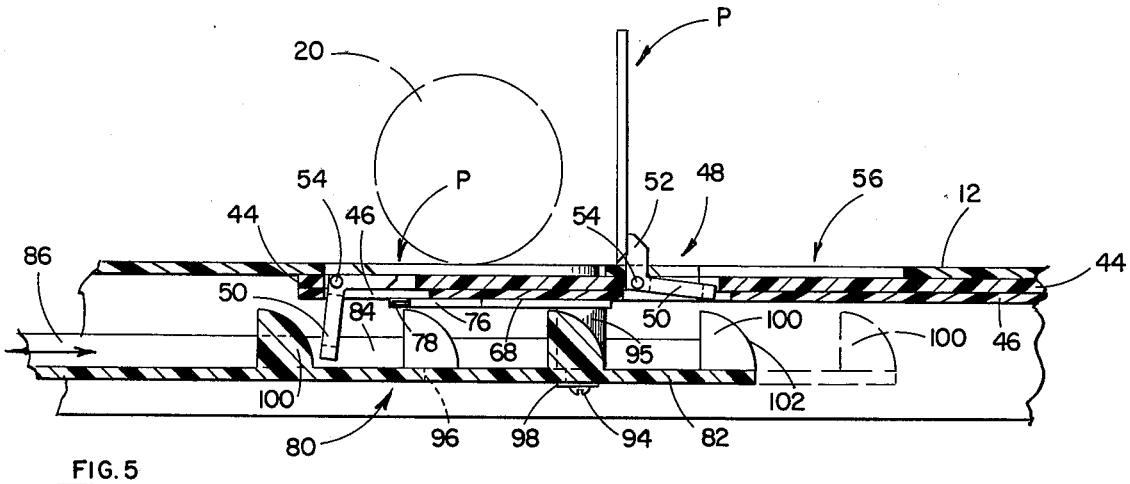
Figure 4:
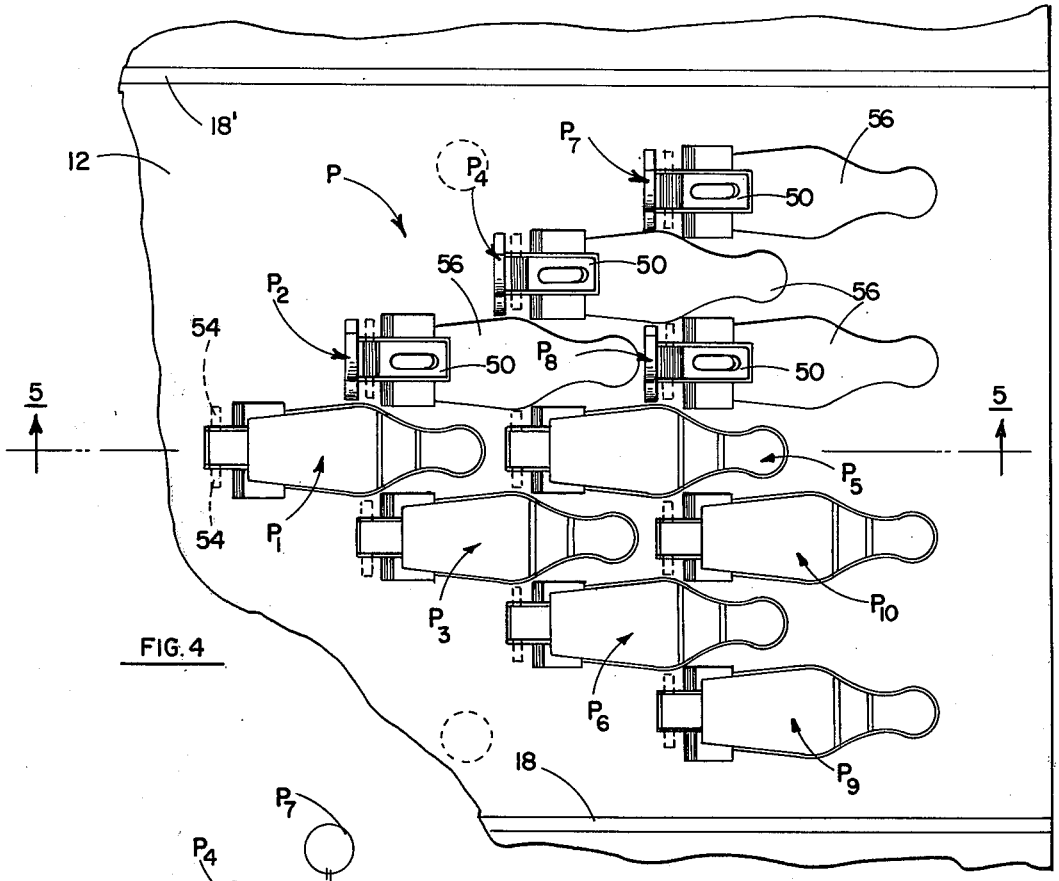
Figure 3:
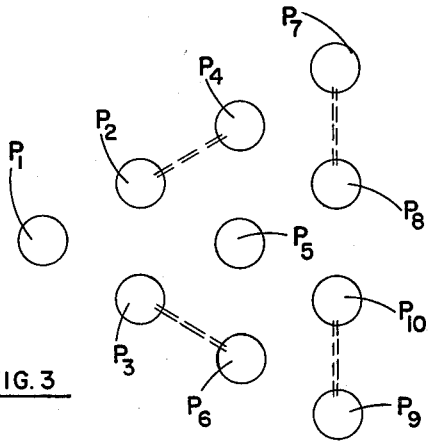
Figure 7:
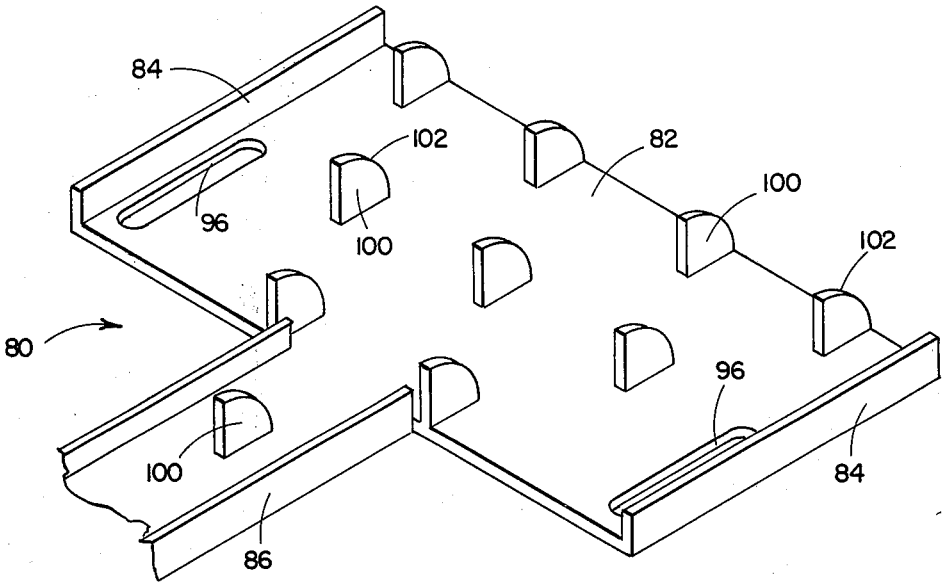
Figure 6:
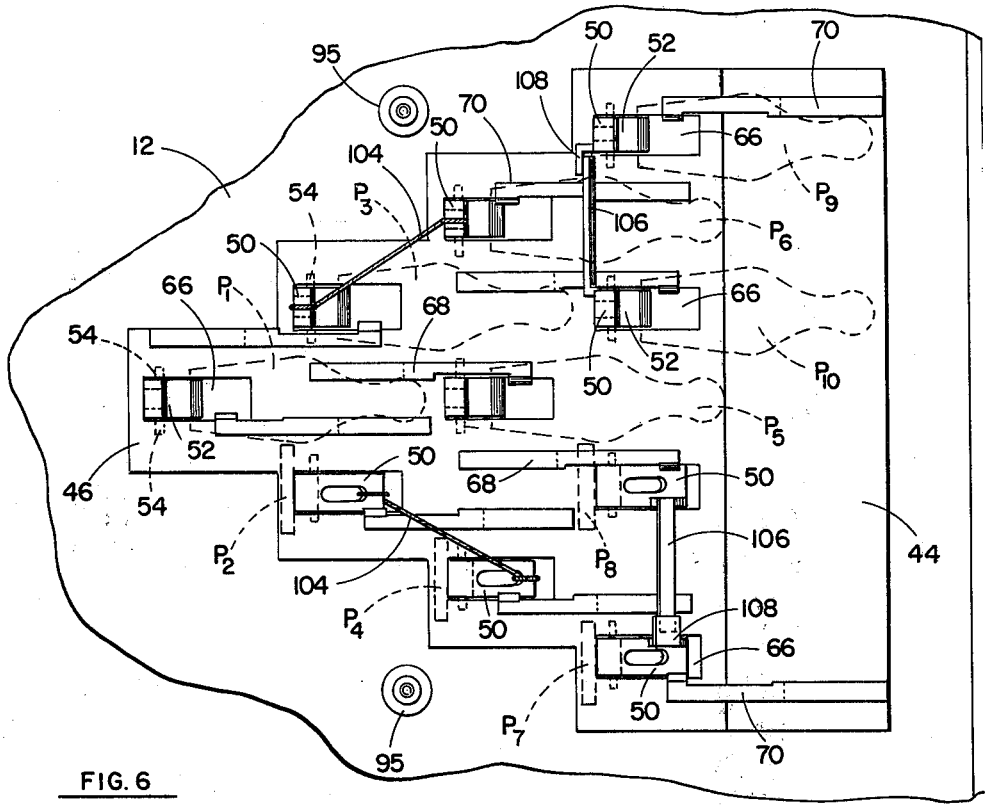
Figure 8:
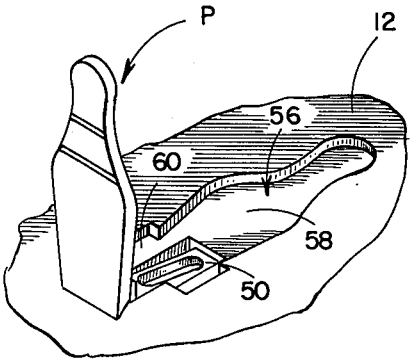
Figure 10:
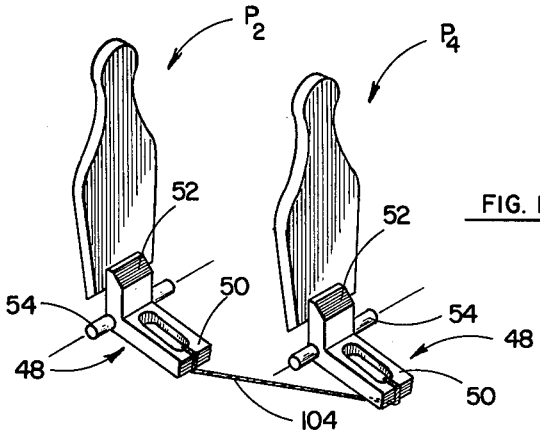
Figure 9:
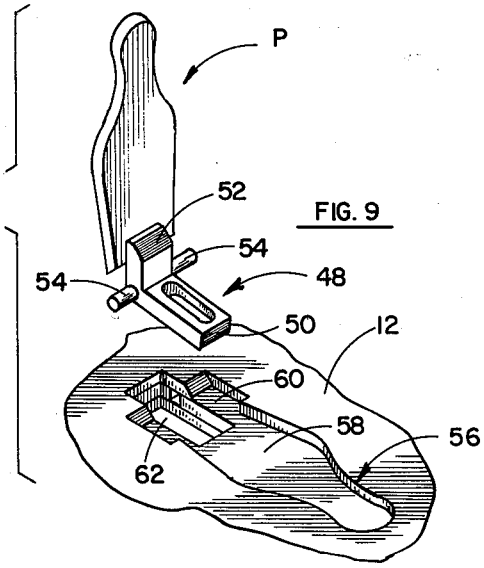
Figure 11:
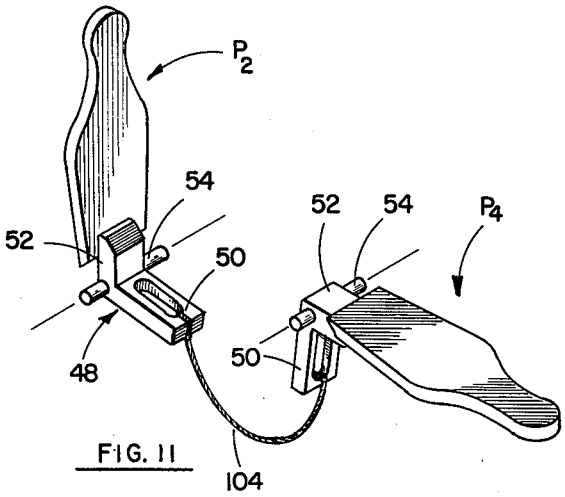
Figure 12:
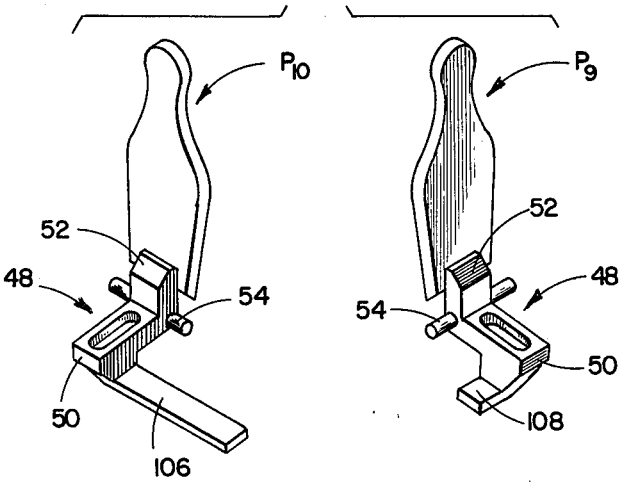
Figure 13:
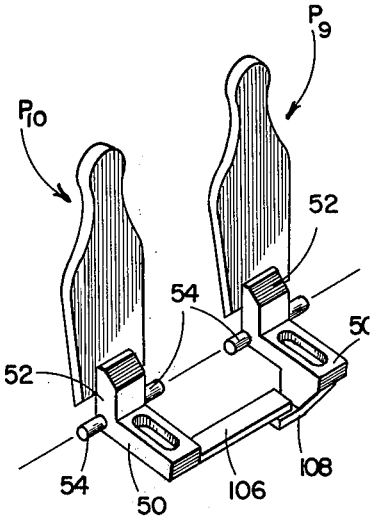
Figure 14:
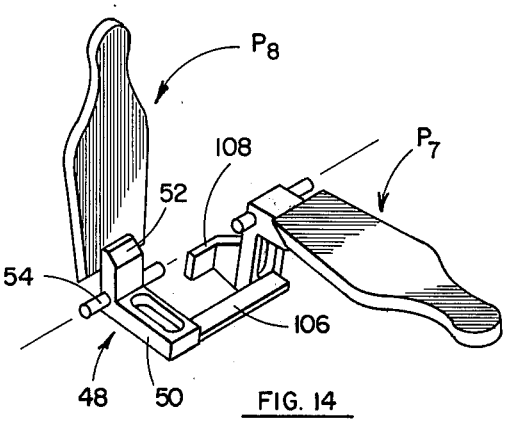
Figure 15:
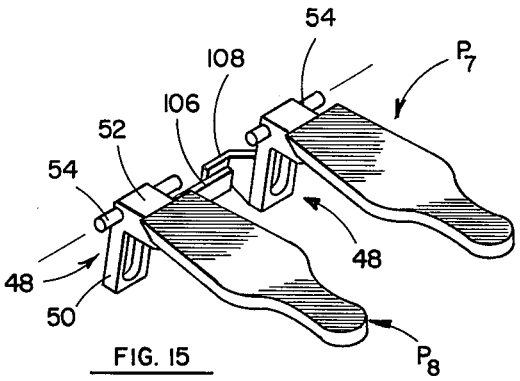
Figure 16:
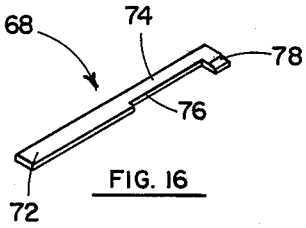
Figure 17:
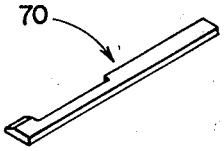
Figure 18:
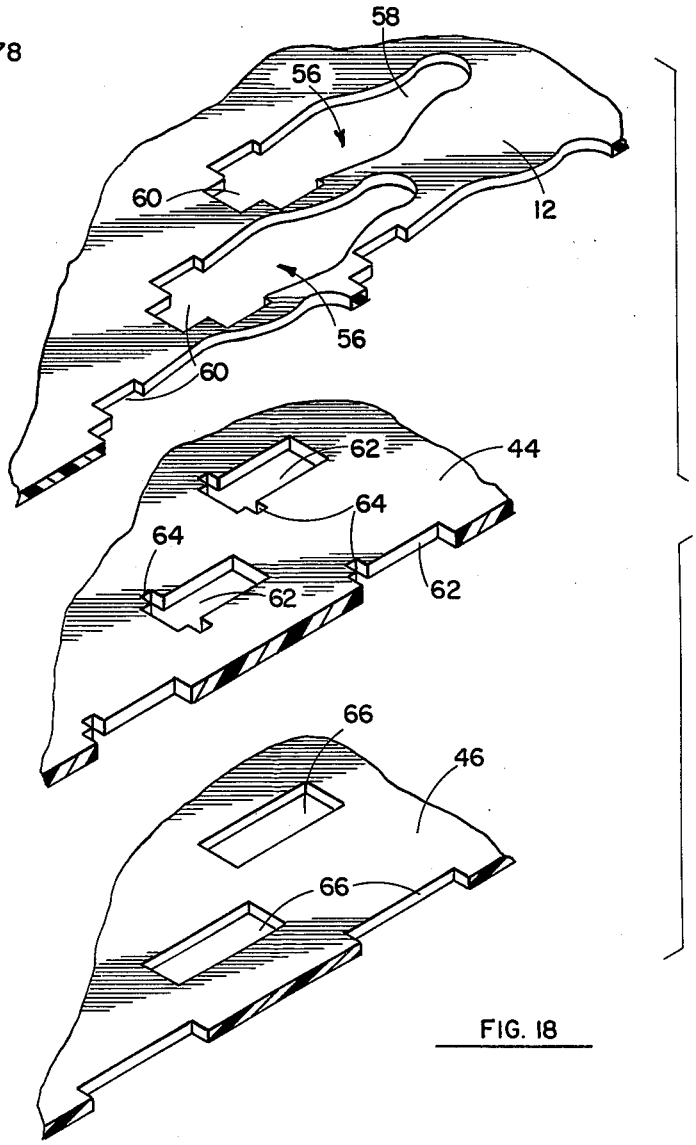

Having thus described the invention in general terms, reference will now be made to the accompanying drawings in which:

FIG. 1 is a top plan view of a bowling game, partially illustrated in dotted lines, and which is constructed in accordance with and embodies the present invention;

FIG. 2 is a vertical sectional view taken along line 2—2 of FIG. 1 and partially illustrated in phantom lines;

FIG. 3 is a schematic top plan view of the arrangement of the bowling pins in the bowling game of the present invention and showing in dotted lines the coaction of several of the bowling pins forming part of this bowling game;

FIG. 4 is a fragmentary top plan view more fully illustrating the relationship between the bowling pins in the bowling game of the present invention when in the down position;

FIG. 5 is a fragmentary vertical sectional view taken along line 5—5 of FIG. 4;

FIG. 6 is a bottom plan view, similar to FIG. 4, and showing a portion of the linkage mechanism which connects various bowling pins forming part of the bowling game of the present invention;

FIG. 7 is a fragmentary perspective view forming part of an actuator plate which is operable with the bowling pins in the bowling game of the present invention;

FIG. 8 is a perspective view of one of the bowling pins and the associated recess forming part of the bowling game of the present invention;

FIG. 9 is an exploded perspective view, similar to FIG. 8, and showing the relationship and the means of connection of a bowling pin to the portion of the bowling alley adjacent to the recess;

FIG. 10 is a perspective view from the rear side of two of the bowling pins forming part of the bowling game of the present invention and the interconnection therebetween;

FIG. 11 is a perspective view, similar to FIG. 10, and showing one of the bowling pins in the downed position whereas another of the bowling pins is in the upright position;

FIG. 12 is a composite perspective view showing a pair of bowling pins with a different type of linkage interconnecting two of the pins;

FIG. 13 is a perspective view, similar to FIG. 12, and showing the relationship between the linkage of two such bowling pins when in the upright position;

FIG. 14 is a perspective view, similar to FIG. 13, and showing one of the bowling pins in the downed position with the other of the bowling pins in the upright position;

FIG. 15 is a perspective view, similar to FIG. 14, and showing the relationship of both of the bowling pins when in the downed position;

FIG. 16 is a perspective view of one form of keeper mechanism which is used with the bowling pins of the present invention;

FIG. 17 is a perspective view of another form of keeper mechanism which is used with the bowling pins forming part of the bowling game of the present invention; and FIG. 18 is an exploded fragmentary perspective view showing the relationship of various members which form part of the frame used in the bowling game of the present invention.

DETAILED DESCRIPTION

Referring now in more detail and by reference characters to the drawings which illustrate a preferred embodiment of the present invention, A designates a toy bowling game comprising a rectangularly shaped frame 10 having an interiorly located planar surface 12 representative of a bowling alley. In this case, and by reference to FIG. 2, it can be observed that the bowling alley 12 inclines downwardly from a player end, designated generally by reference numeral 14, to a score depicting end, often referred to as a bowling pin end 16 opposite thereto, in the manner as illustrated in FIGS. 1 and 2 of the drawings.

The bowling alley 12 may be suitably imprinted on its upper surface with a pair of strike lines designated by reference numerals 18 and 18' which properly depict the proper bowling area therebetween. This proper bowling area is that area in which the playing piece, such as a bowling ball 20, should travel in order to obtain proper scoring. Located rearwardly of the bowling pin area 16 is a ball receiving trough 22 which is located vertically beneath a rearward edge 24 of the bowling alleg 12, reference being made to FIG. 1, and in the manner as illustrated in FIG. 1 of the drawings. The ball receiving trough 20 also inclines downwardly from the left-hand side to the right-hand side, again referring to FIGS. 1 and 2, so that the bowling ball will roll downwardly to a bowling ball actuating member 26.

The bowling ball actuating member 26 comprises a ball return arm 28 which is pivotally mounted on the frame 10 by means of a pivot pin 30. At its rearward end, the ball return arm 28 includes a socket 32 which is sized to accommodate the bowling ball 20 as it rolls down the ball receiving trough 22. A lever 34 is secured to one end of the pin 30 outwardly of the frame 10 and which is manually actuable by a player of the game. Thus, when the lever 34 is urged upwardly, it will rotate the pivot pin 30 which is secured to the arm 28 and which will cause the arm 28 to shift upwardly to the position designated by the phantom lines in FIG. 2 and which is also designated by reference numeral 28'. In like manner, the ball receiving socket 32 will also similarly shift to the upper or ball ejecting position designated by reference numeral 32'. In this respect, the arm 28 could be spring biased to its return position by means of any conventional spring mechanism or other form of bias mechanism (now shown) which will shift the arm, and hence the socket 32, to the lower position as illustrated in FIGS. 1 and 2 of the drawings.

When the bowling ball 20 is ejected by the socket 32 after it has shifted to its uppermost or ejecting position, as illustrated by reference numeral 32', the ball 20 will be ejected into a ball return trough 34, which is separated from the planar surface 12 by means of an upstanding wall 36 which projects from the planar surface 12. The ball return trough 34 is also provided with a return base wall 38 which is initially rearwardly and downwardly inclined so that the ball will roll toward a ball retaining recess 40 over a retaining hump 42 formed in the base wall 38. It can be observed that the base wall 38 is formed of sufficient length and sufficient incline so that the ball 20 will have sufficient velocity to roll over the hump 42 and into the retaining recess 40, in the manner as illustrated in FIG. 2 of the drawings.

Located at the bowling pin end, or the so-called "score depicting end" 16, are a plurality of elements P representative of bowling pins. In this case, the elements P are designed to have a planar surface representative of the shape of a bowling pin, although the elements P, which are hereinafter referred to as "bowling pins", are not circular in shape and are not loosely and removably disposed upon the bowling alley 12. In accordance with the rules of a normal bowling game, 10 such bowling pins P are provided and, for purposes of more fully describing the present invention, are designated as bowling pins $P_1$, $P_2$, $P_3$ ...$P_{10}$. This arrangement is more fully illustrated in FIGS. 1, 3 and 4 of the drawings.

In the normal bowling game, 10 bowling pins P are provided as indicated above, and these bowling pins are substantially arranged in the manner as illustrated in FIGS. 3 and 4 of the drawings. Thus, in this case, four rows of bowling pins are provided and are rearwardly spaced with respect to the player end 14 and located in the score-depicting end 16. In the first row, one such bowling pin is provided and, in this case, is designated by reference numeral $P_1$. In the second row, two bowling pins are provided and are respectively designated as $P_2$ and $P_3$. In the third row, three bowling pins are provided and are respectively designated, $P_4$, $P_5$, and $P_6$. Finally, in the fourth row four bowling pins are provided and are respectively designated as $P_7$, and $P_8$, as well as $P_9$ and $P_{10}$ in the arrangement as illustrated in FIGS. 3 and 4 of the drawings. In this case, it can be observed that the bowling pins $P_4$ and $P_6$ are the outermost bowling pins in the fourth row and the bowling pins $P_7$ and $P_9$ are the outermost bowling pins in the fourth row.

By further reference to FIG. 3, it can be observed that one of the bowling pins $P_2$ in the second row is coupled to one of the outermost bowling pins $P_4$ in the third row and operates in conjunction therewith. In like manner, one of the other bowling pins $P_3$ in the second row is coupled to the other outermost bowling pin $P_6$ and operates in conjunction therewith. Furthermore, it can be observed that one of the outermost bowling pins $P_7$ in the fourth row is coupled to next adjacent inner bowling pin $P_8$ in the fourth row. Similarly, the other outermost bowling pin $P_9$ in the fourth row is coupled to the next adjacent innermost bowling pin $P_{10}$ in the fourth row and operates in conjunction therewith. The co-action between these various coupled bowling pins will be described in more detail hereinafter.

However, for purposes of initially describing the operation of the bowling pins P with respect to the contact by the bowling ball 20, the bowling pin $P_2$, when contacted by the playing piece, such as the bowling ball 20, will be shifted from its first position, that is its upright position as designated in FIG. 2 of the drawings, to its second position, or so-called down position when contacted by the bowling ball. In this case, the bowling pin $P_4$ will also be knocked to the downed or second position, even though the bowling pin $P_4$ is not contacted by the bowling ball 20. In like manner, the bowling pin $P_3$ will also be knocked down to the second position and, furthermore, the bowling pin $P_6$ coupled to the bowling pin $P_3$ will also be knocked down to the second position even though the bowling pin $P_6$ is not contacted by the bowling ball 20.

However, the converse differs in that if the bowling pin $P_4$ is knocked to the second position without the bowling ball 20 contacting the bowling pin $P_2$, the bowling pin $P_2$ will not be knocked to the second position. In like manner, if the bowling pin $P_6$ is knocked to the second position by contact with the bowling ball 20, the bowling pin $P_3$ will not be knocked to the second position if it is not contacted by the bowling ball.

Referring to the last row containing pins $P_7$...$P_{10}$, the bowling pin $P_8$ will be knocked to the second position, that its down position, when contacted by the bowling ball 20 and, in this case, since it is coupled to the bowling pin $P_7$, the bowling pin $P_7$ will also be knocked to the second position even though the latter is not contacted by the bowling ball. In addition, the bowling pin $P_9$ will be shifted to the second position if the bowling pin $P_{10}$ is contacted by the bowling ball and knocked to the second position. However, the same converse also holds in that the bowling pin $P_8$ will not be knocked to the second position if only the bowling pin $P_7$ is contacted by the bowling ball 20. In like manner, the bowling pin $P_{10}$ will not be knocked to the second position if only the bowling pin $P_9$ is contacted by the bowling ball 20.

By further reference to FIGS. 4 and 6 of the drawings, it can be observed that the bowling pins are so located such that they can be moved from the first or upright position to the second or down position without contacting any other bowling pins. In accordance with this normal arrangement, the player of the game could bowl a perfect strike, that is roll the bowling ball 20 in its perfect strike position without knocking down all of the pins P. Consequently, the coupling arrangement which is schematically illustrated in FIG. 3 permits all of the pins to be knocked down to the second position when the player of the game rolls the bowling ball 20 to initiate a perfect score. This coupling arrangement between the various pins P will be described in more detail hereinafter.

Rigidly secured to the underside of the bowling alley in the region of the bowling pins P, by means of bolts, rivets, adhesives or other forms of conventional fastening techniques (not shown) is a mounting plate 44 which is more fully illustrated in FIGS. 5 and 6 of the drawings. Also secured to the mounting plate 44 on the underside thereof, also in the manner as more fully illustrated in FIGS. 5 and 6 of the drawings, is a keeper plate 46. The keeper plate 46 may be similarly secured to the mounting plate 44 by any form of conventional technique including fasteners of the type mentioned, as well as adhesives, etc.

By reference to FIGS. 4, 6, 8, and 9, it can be observed that each of the bowling pins P, are each hingedly mounted on the bowling alley 12 by means of brackets 48. Each of the brackets 48 comprises a retaining plate 50, which is initially horizontally disposed when the pins P are located in the first or upright position. Extending upwardly from the plate 50 in perpendicular relationship thereto is a mounting flange 52 and which is, in turn, secured to the lower end of the pins P. This connection between the mounting flange 52 and the plate 50 is provided with a transversely extending pivot pin 54 which is, in turn, retained in the mounting plate 44 in the manner as more fully illustrated in FIGS. 4, 5, and 9 of the drawings.

By further reference to FIGS. 5, 8, and 9 of the drawings, it can be observed that the bowling alley 12 is provided immediately rearwardly of each of the pins P with an aperture 56, sized to accommodate the pins P and the bracket 48. In this case, it can be observed that the aperture 56 actually comprises a bowling pin receiving section 58 with a bracket receiving section 60, the latter having the shape as illustrated in FIG. 18 in order to accommodate the bracket 48, and particularly the flange 52 thereof.

It can also be observed, by reference to FIG. 18, that the mounting plate 44 is similarly provided with apertures 62, each being in alignment with each one of the apertures 56. Moreover, it can be observed that the apertures 62 are provided with a pair of outwardly extending opposed slots 64, which are sized to accommodate the outwardly extending ends of the transversely extending pin 54. In addition, it can also be observed by reference to FIG. 18 that the keeper plate 46 is provided with rectangularly shaped apertures 66 each being located in communication with the associated aperture 62 and with a portion of the associated aperture 56. This same construction is the same for each of the ten bowling pins P.

FIGS. 8 and 9 more fully illustrate the hinged connection of each of the bowling pins P to the frame 10. It can be observed that pivot pin is held within the slots 64 formed in the aperture 62 which is located in the mounting plate 44. The bowling alley 12 and the keeper plate 46 will retain the pivot pins within the slots 64 such that the bowling pins P can shift from the first upstanding position, as illustrated in FIG. 1, to the second or downed position, as illustrated in FIG. 2.

When the pins P are engaged by the bowling ball 20 and pushed to the down position, the plate 50 will shift through the apertures 62 and 66 so that they are located in a substantially vertical position, while the outer surface of the pins P are located in the horizontal position. Moreover, it should be observed by reference to FIGS. 8 and 9 that the thickness of the bowling pins P is substantially equal to the thickness (in the vertical dimension) of the recesses 56. In this way, when each of the pins P is shifted to the down position, they will be urged into the recess 56 exposed immediately rearwardly thereof and the outwardly presented planar surface of the bowling pins P will be thereupon flush with the planar surface or bowling alley 12. Moreover, the bowling pins P will be retained in this position so that their outer surfaces are flush with the bowling alley 12 by means of the mounting plate 44 disposed immediately therebeneath.

As indicated previously, the bowling alley 12 inclines downwardly from the player end 14 to the bowling pin end 16. FIG. 5 has been drawn to illustrate the bowling alley in a relatively horizontal plane, in order to maintain clarity. However, it can be observed that the bowling pins P could therefore be located so that the forwardly presenting surface thereof, that is the surface presented toward the player end 14, is located at greater than a 90° angle with respect to the upper surface of the bowling alley 12. Consequently, this arrangement with respect to the bracket 48 is more fully illustrated in FIG. 5 of the drawings.

Each of the bowling pins P are retained in the upper, or first, position by means of retaining arms 68 and 70, often referred to as "keepers", which are more fully illustrated in FIGS. 16 and 17 of the drawings, respectively. The actual positioning of the retaining arms is more fully illustrated in FIGS. 5 and 6 of the drawings. The retaining arm 68 includes an elongated mounting portion 72 which is fixedly secured to the underside of the keeper plate 46, preferably by a means of adhesives or any other known form of attachment. Extending outwardly therefrom is a somewhat resilient section 74 having a recess 76 and an outwardly projecting abutment 78, in the manner as more fully illustrated in FIG. 16 of the drawings.

The retaining arm 68 is mounted in such manner that the plate 50 will move within the area of the recess 76. Thus, when any of the pins P are pushed to the upright position, the resilient section 74 will be biased to the left, reference being made to FIG. 16, when the abutment 78 engages the plate 50. Moreover, the abutment 78 will be located immediately disposed with relationship to the plate 50 so that the abutment 78 engages the underside of the plate 50 in order to hold the pin P in the upright position. In this respect, it can be observed that the resilient section 74 is not only resilient in the transverse direction, but is also resilient in the vertical direction so that the abutment 78 can shift outwardly with respect to the plate 50 as it is being shifted to its horizontal position, and, in addition, can be shifted downwardly beneath the plate 50. Moreover, the resiliency of the entire retaining arm 68 is designed so that when any of the bowling pins P are contacted by the bowling ball 20 the force imposed on the plate 50 is sufficient to push resilient section 74, and hence the abutment 78, both downwardly and outwardly from the plate 50 to permit the plate 50 to swing to its vertical position. In this way, the pin P can be shifted to the second position and located within the recess 56.

The retaining arm 70 is substantially identical in construction to retaining arm 68 and operates in like manner, except that it is located on opposite sides of the pins with respect to the retaining arm 68. By further reference 6, it can be observed that retaining arms 68 are associated with the pins $P_3$, $P_5$, $P_8$ and $P_{10}$. In like manner, the retaining arms 70 are associated with the bowling pins $P_1$, $P_2$, $P_4$, $P_6$, $P_7$, and $P_9$.

In accordance with the normal game of bowling, each player is permitted to roll the bowling ball 20 in two rolls in order to constitute one frame. Thus, after the player of the game rolls a ball the first time, the player may knock down all of the bowling pins P in order to achieve a "strike". In like manner, the player may knock down only certain of the bowling pins P in which case the player is entitled to roll the bowling ball 20 a second time. After the player rolls the ball the second time, the player may or may not knock down additional bowling pins. Thus, if all of the bowling pins have been knocked down to the second position, the player will have achieved a "spare", again in accordance with the rules of the game of bowling.

After two rolls of the ball, or otherwise after the player has achieved a strike, it is necessary to shift the bowling pins P to their upright position. For this purpose, a bowling pin actuator 80 is provided and is more fully illustrated in FIGS. 1, 5 and 7 of the drawings. The bowling pin actuator 80 generally comprises a horizontally disposed camming plate 82 with a pair of transversely spaced apart longitudinally extending and upstanding arms 84. Integrally formed with the camming plate 82 and extending toward the player end 14 is an elongate arm 84 which has an actuator handle 86 projecting outwardly of an aperture 88 in the end wall forming part of the fram 10, in the manner as illustrated in FIG. 1 of the drawings.

The camming plate 82 is always urged forwardly, that is, in the direction of the player end 12, by means of a compression spring 90, which is secured to the end wall of the frame 10 and having the aperture 88 and to a flange 92 integrally formed with the arm 86. Thus, it can be observed that, if the player of the game pushes the actuator handle 86 inwardly, that is rearwardly, the compression spring 90 will expand and when the force is released upon the actuator handle 86, the compression spring 90 will bias the arm 86 and hence the camming plate 82 forwardly.

By further reference to FIG. 1, it can be seen that the camming plate 82 is located in the region of the bowling pins P. The camming plate 82 is retained by means of pins 94 having shanks (not shown) which extend through elongated slots 96 formed within the camming plate 82. The shanks of the pins 94 are retained within downwardly extending tubular hubs 95 (FIG. 5) formed on the underside of the bowling alley 12. Moreover, the heads of the pins 94 are provided with washers 98. In this way, it can be observed that the washers 98 merely hold the camming plate 82 in a relatively parallel position with respect to the underside of the bowling alley 12. Inasmuch as the shanks are slideable in the elongated slots 96, the camming plate 82 is free to shift back and forth in a longitudinal position.

The camming plate 82 is provided with a plurality of upstanding cams 100, and one of these cams in this case is located on the arm 86. It can be observed that each of the cams 100 are provided with rearwardly presented, arcuately shaped camming faces 102.

As the actuator 80 is pushed rearwardly by means of a player engaging the actuator handle 86 and pushing the same rearwardly, the camming plate 82 will also shift rearwardly and the cams 100 will engage the downwardly presented, vertically struck plates 50 forming part of the brackets 48. As this occurs, the various camming surfaces 102 will force the arm 50 to rotate about the pivot pins 54 and shift the arms to the horizontal position, as illustrated in FIGS. 8 and 14 of the drawings. In this way, the pins P will be located in the upright position.

As the plates 50 are being pushed upwardly by means of the cams 100, the abutments 78 on the various retaining arms 68 and 70 will initially shift slightly outwardly and downwardly with respect to the underside of the plate 50 and thereupon engage the underside of the plate 50 holding the bowling pins P in the upright position, in the manner as previously described. Thereafter, when the player of the game releases the actuator handle 86, the spring 90 will pull the actuator 80, and hence the camming plate 82, in the forwardly direction, out of the way of the action of the brackets 48.

As indicated previously, the bowling pin $P_2$ is coupled to the bowling pin $P_4$ and the bowling pin $P_3$ is coupled to the bowling pin $P_6$. In accordance with this coupling arrangement, it was indicated that the bowling pin $P_2$ could be knocked down to the second position by means of the bowling ball 20, and this would in turn knock the bowling pin $P_4$ down to the second position, even though the bowling pin $P_4$ was not contacted by the bowling ball 20. In like manner, the bowling pin $P_6$ would be knocked down to the second position when the bowling pin $P_3$ was knocked to the second position upon contact by the bowling ball, even if the bowling pin $P_6$ was not so contacted by the bowling ball 20.

The linkage necessary to create this action is more fully illustrated in FIGS. 10 and 11 of the drawings. In this case, it can be observed that the two bowling pins $P_2$ and $P_4$ are illustrated. It can be seen that the plate 50 on the bracket 48 associated with the bowling pin $P_2$ is provided with a cord 104 which is similarly connected to the plate 50 associated with the bowling pin $P_4$. Thus, it can be observed that when the two bowling pins $P_2$ and $P_4$ are in the upright position, the cord 104 is fairly taut. However, if only the bowling pin $P_4$ were contacted by the bowling ball 20, only the bowling pin $P_4$ would be knocked down to the second position, as illustrated in FIG. 11 of the drawings. Consequently, if the bowling pin $P_2$ were subsequently contacted by a bowling ball, it would also be knocked down to the second position independently of the bowling pin $P_4$.

In the alternative, if the bowling pin $P_2$ is first contacted by the bowling ball 20, it can be observed that inasmuch as the cord 104 is taut, the arm 50 will be shifted downwardly to the left, reference being made to FIG. 10. If this occurs, the cord 104 will also pull the arm 50 associated with the pin $P_4$ downwardly. Consequently, when the bowling ball 20 first contacts the bowling pin $P_2$, both the bowling pins $P_2$ and $P_4$ would operate in like manner.

It was also indicated previously that the bowling pins $P_7$ is coupled to the bowling pin $P_8$ and the bowling pin $P_9$ is coupled to the bowling pin $P_{10}$. In accordance with this coupling arrangement, the bowling pin $P_7$ could be knocked down to the second position independently of the bowling pin $P_8$. However, if the bowling pin $P_8$ were contacted by the bowling ball 20, it would be knocked to the second position and would also knock the bowling pin $P_7$ to the second position, even though the latter was not contacted by the bowling ball. In like manner, the bowling pin $P_9$ could be independently knocked to the second position, even though the bowling pin $P_{10}$ was not knocked to the second position. Moreover, the bowling pin $P_{10}$ could be knocked to the second position and would similarly pull the bowling pin $P_9$ to the second position, even though the latter were not contacted by the bowling ball. It can be observed that each of these pins $P_7$, $P_8$, $P_9$ and $P_{10}$ are all located in the same row whereas the bowling pins $P_2$ and $P_4$, as well as the bowling pins $P_3$ and $P_6$ were not located in the same row. Consequently, a different coupling arrangement is provided and this coupling arrangement is more fully illustrated in FIGS. 12–15 of the drawings.

The bowling pins $P_7$ and $P_8$ are more fully illustrated in FIGS. 12–15 of the drawings. In this case, it can be observed that the plate 50 forming part of the bracket 48 associated with the bowling pin $P_8$ has a transversely struck engaging arm 106 which is projected toward the plate 50 associated with the bowling pin $P_7$. In like manner, the arm 50 associated with the bowling pin $P_7$ is provided with a transversely struck, relatively short cooperating engagement arm 108.

By reference to FIG. 13, it can be observed that when both the bowling pins $P_7$ and $P_8$ are in the upright position, that the cooperating engagement arm 108 will be located beneath the engagement arm 106. By reference to FIG. 14, it can be observed that if the bowling pin $P_7$ were contacted by the bowling ball 20, it would be knocked down to the second position independently of the bowling pin $P_8$. It can be seen that since the engaging arm 108 associated the bowling pin $P_7$ is located beneath the engaging arm 106 associated with the bowling pin $P_8$, that the pin $P_7$ can be shifted downwardly without otherwise affecting the arm $P_8$. However, it can be also observed, by reference to FIG. 15, that if bowling ball contacts the pin $P_8$, this latter bowling pin will be pushed downwardly to the second position. Moreover, since the engagement arm 106 lies above the engagement arm 108, it will also push the engagement arm in the arcuate arm with pivotal movement above the pivot pin 54. Consequently, the bowling pin $P_7$ will also be urged downwardly to the second position, along with the bowling pin $P_8$.

Thus, there has been illustrated and described a unique and novel bowling game which provided for hingedly mounted pins capable of being shifted from an upright position to a knocked down position and reshifted to the upright position through an actuating mechanism in the bowling game, and which therefore fulfills all of the objects and advantages sought therefor. It should be understood that many changes, modifications, variations and other uses and applications could be made by the skilled artisan after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by letters patent is:

1. A toy bowling game comprising:

a. a bowling alley, b. a plurality of rows of bowling pin-like elements with a plurality of pin-like elements in some of said rows, c. hinge means hingedly connecting each of said pin-like elements to said alley so that said pin-like elements can shift from a first upright position to a second knocked-down position, d. a flexible cord link connecting at least a first one of said pin-like elements to a second of said pin-like elements so that said first and second pin-like elements selectively cooperatively act when contacted by a playing piece, e. a fairly rigid link connecting a third of said pin-like elements to a fourth of said pin-like elements, so that said third and fourth pin-like elements selectively cooperatively act when contacted by a playing piece.

2. The toy bowling game of claim 1 further characterized in that the first one and second one of said pin-like elements are located in different rows.

3. The toy bowling game of claim 1 further characterized in that the third and fourth of said pin-like elements are located in the same row.

4. The toy bowling game of claim 1 further characterized in that the first and second one of said pin-like elements are located in different rows, and the third and fourth of said pin-like elements are located in the same row.

5. The toy bowling game of claim 1 further characterized in that a recess is associated with each said element and receives said element in the second position so that one planar surface of said elements is substantially flush with said bowling alley.

6. The toy bowling game of claim 1 further characterized in that actuating means is operatively associated with said bowling alley and said elements to shift said elements from the second to the first position by actuation from an area remote to said elements.

7. The toy bowling game of claim 1 further characterized in that said bowling alley inclines downwardly from a location where said playing piece may be released to the location of said elements.

* * * * *